US011543779B1

(12) United States Patent
Webber

(10) Patent No.: US 11,543,779 B1
(45) Date of Patent: Jan. 3, 2023

(54) TIMEPIECE WATCH FACE

(71) Applicant: Meridyth Mischel Webber, Fort Lee, NJ (US)

(72) Inventor: Meridyth Mischel Webber, Fort Lee, NJ (US)

( * ) Notice: Subject to any disclaimer, the term of this patent is extended or adjusted under 35 U.S.C. 154(b) by 0 days.

(21) Appl. No.: 17/874,882

(22) Filed: Jul. 27, 2022

Related U.S. Application Data

(60) Provisional application No. 63/473,665, filed on Jun. 17, 2022.

(51) Int. Cl.
*G04B 19/04* (2006.01)
*G04B 45/00* (2006.01)

(52) U.S. Cl.
CPC ..... *G04B 45/003* (2013.01); *G04B 19/04* (2013.01)

(58) Field of Classification Search
CPC ..... G04C 17/0091; G04G 9/0094; G04B 47/044; G04B 45/0038; G04B 45/003; G04B 45/00; G04B 19/04
See application file for complete search history.

(56) References Cited

U.S. PATENT DOCUMENTS 2,749,704 A * 6/1956 Heikkila ..... G04B 27/004 D10/23
3,148,500 A * 9/1964 Hayes ..... G04B 45/0061 968/389
3,823,549 A 7/1974 Feldman
4,834,475 A * 5/1989 Robinson ..... G01D 13/02 368/79
5,297,112 A 3/1994 Cohen et al.
5,380,206 A * 1/1995 Asprey ..... G04B 45/0061 434/257
D388,735 S 1/1998 Webber
D393,604 S 4/1998 Webber
5,845,518 A 12/1998 Webber
5,862,102 A * 1/1999 Trainello ..... G04B 45/0038 368/77
5,940,349 A 8/1999 Stewart
7,031,485 B2 4/2006 Webber et al.
D535,206 S 1/2007 Skaggs
7,339,856 B1 * 3/2008 Hardesty ..... G04B 45/0038 368/228
7,505,370 B2 3/2009 Rydgren
9,377,762 B2 6/2016 Hoobler et al.
D771,589 S 11/2016 Webber
9,733,622 B2 8/2017 Knuchel
10,120,344 B2 11/2018 Yuen
(Continued)

OTHER PUBLICATIONS

Vintage 1990s Youth Wilson Michael Jordan Rotating Basketball Watch on eBay https://www.ebay.com/itm/185485752223?mkcid=16&mkevt=1&mkrid=711-127632-2357-0&ssspo=VK9rtxHXRJS&sssrc=2349624&ssuid=SngF4BgYQA2&var=&widget_ver=artemis&media=EMAIL.

*Primary Examiner* — Sean Kayes
(74) *Attorney, Agent, or Firm* — Salter & Michaelson

(57) ABSTRACT

A timepiece having a face member with a face surface that displays indicia that is representative of a sports player and the associated sports player sports environment; time hands that represent at least a seconds hand that has a rotatable position about a center axis of the face member; an object that is carried by a distal portion of the seconds hand; the face member depicting a net disposed at a predetermined location on the face surface with the object positioned so that it passes through the net as the seconds hand rotates.

3 Claims, 9 Drawing Sheets

(56) References Cited

U.S. PATENT DOCUMENTS

| | | | | |
|---|---|---|---|---|
| 10,304,347 | B2 | 5/2019 | Wilson et al. | |
| 2003/0231555 | A1* | 12/2003 | Sullivan | G04B 25/06 368/223 |
| 2009/0016168 | A1* | 1/2009 | Smith | G04G 9/02 368/10 |
| 2019/0056696 | A1* | 2/2019 | Tortora | G04B 19/10 |

* cited by examiner

TIMEPIECE WATCH FACE

RELATED CASES

Priority for this application is hereby claimed under 35 U.S.C. § 119(e) to commonly owned and U.S. Provisional Patent Application No. 63/473,665 which was filed on Jun. 17, 2022 and which is incorporated by reference herein in its entirety.

TECHNICAL FIELD

The present invention is directed to an improvement in a watch face for a timepiece. More particularly, the present invention illustrates an improved watch face construction in which the second hand of the timepiece carries a sports object such as a ball.

BACKGROUND OF THE INVENTION

There presently exists several different types of watches that contain images of sports players. However, any existing watches do not show an interaction between the sports player and an object associated with the sports player.

Accordingly, it is an object of the present invention to provide an improved watch face for a timepiece in which there is a relationship between the sports player, an object handled by the sports player and a net through which the object is to pass.

SUMMARY OF THE INVENTION

To accomplish the foregoing and other objects and advantages of the present invention there is provided a watch face construction that is comprised of a face member having indicia indicating a time sequence that includes, inter alia, a seconds hand that has a rotatable position about a center axis of the face member, an object that is carried by a distal portion of the seconds hand, the depiction of a net disposed at a predetermined location on the face member, the object positioned so that it passes through the net.

In accordance with other aspects of the present invention the face member is comprised of at least two separate graphic layers; the graphic layers include one layer that depicts the face member indicia and a second layer that includes a depiction of the net; the graphic layers also include a third layer that includes a depiction of the net; the third layer depicts the net in a position different than the position of the net in the second layer; the depiction of the second layer of the net in a position different than the position of the net in the second layer simulates movement of the net as the object passes through the net; the object is a ball; and the net is one of a basketball net, a soccer net, and a hockey net.

In accordance with another version of the present invention there is provided a timepiece that is comprised of: a face crystal having a face surface that displays indicia that is representative of a sports player and the associated sports player sports environment; time hands that represent at least a seconds hand that has a rotatable position about a center axis of the face member; an object that is carried by a distal portion of the seconds hand; the face crystal depicting a net disposed at a predetermined location on the face surface; the object positioned so that it passes through the net.

In accordance with still other aspects of the present invention there is further included a transparent layer that is disposed behind the face crystal; wherein the transparent layer includes a depiction of a net; including a second transparent layer that is disposed behind the first transparent layer and that includes a depiction of the net; wherein the depiction of the net on the second layer is in the form of a hologram so as to depict movement of the net as the object passes through the net; wherein the object is a ball; and wherein the net is one of a basketball net, a soccer net, and a hockey net.

In accordance with still another version of the present invention there is provided a method of simulating a sports game action on a watch face that includes a face member having indicia indicating a time sequence that includes, inter alia, a seconds hand, causing the seconds hand to rotate through 360 degrees about a center axis of the face member, placing an object on the seconds hand and that is carried by a distal portion of the seconds hand, providing a depiction of a net disposed at a predetermined location on the face member, and positioning the object on the seconds hand so that it passes through the net upon being rotated.

In accordance with still other aspects of the present invention there is including providing the net on a separate transparent layer that is disposed behind the face member; including providing the net on a back side of face member; including providing a hologram on a separate transparent layer that is disposed behind the face member; and wherein the object is a ball, and the net is one of a basketball net, a soccer net, and a hockey net.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
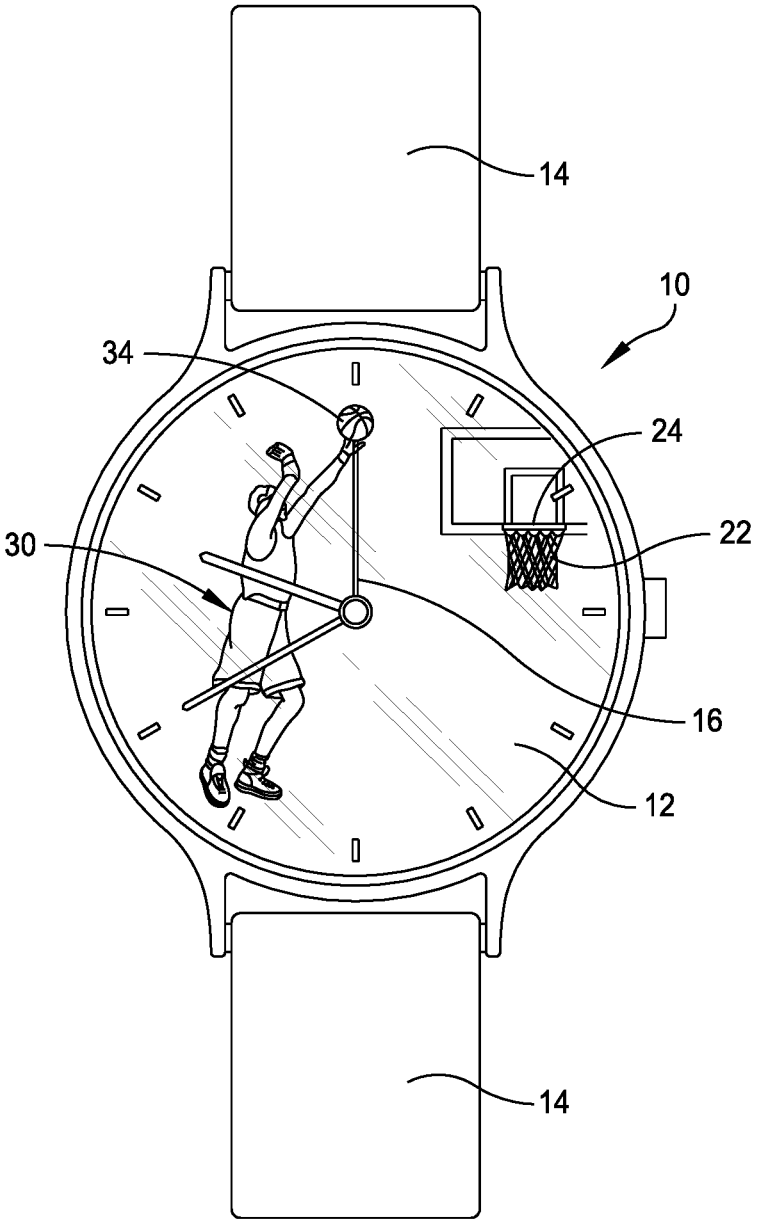
FIG. 1 is an illustration in a front view of a timepiece embodying a new and novel watch face.
Figure 2:
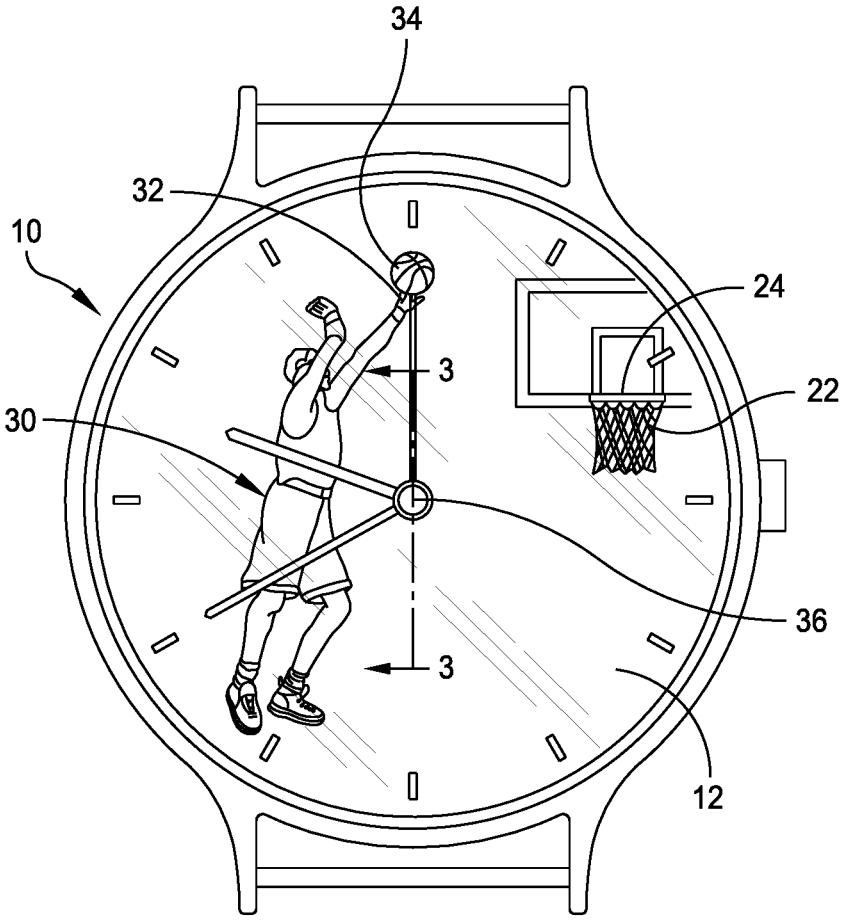
FIG. 2 is a slightly enlarged view of FIG. 1 without the watch band.
Figure 3:
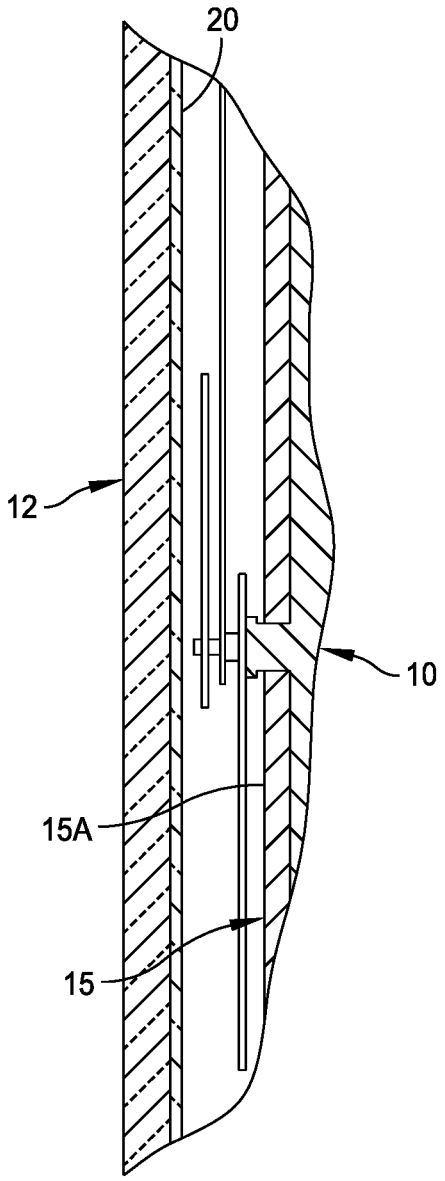
FIG. 3 is cross-sectional view taken along line 3-3 of FIG. 2.
Figure 4:
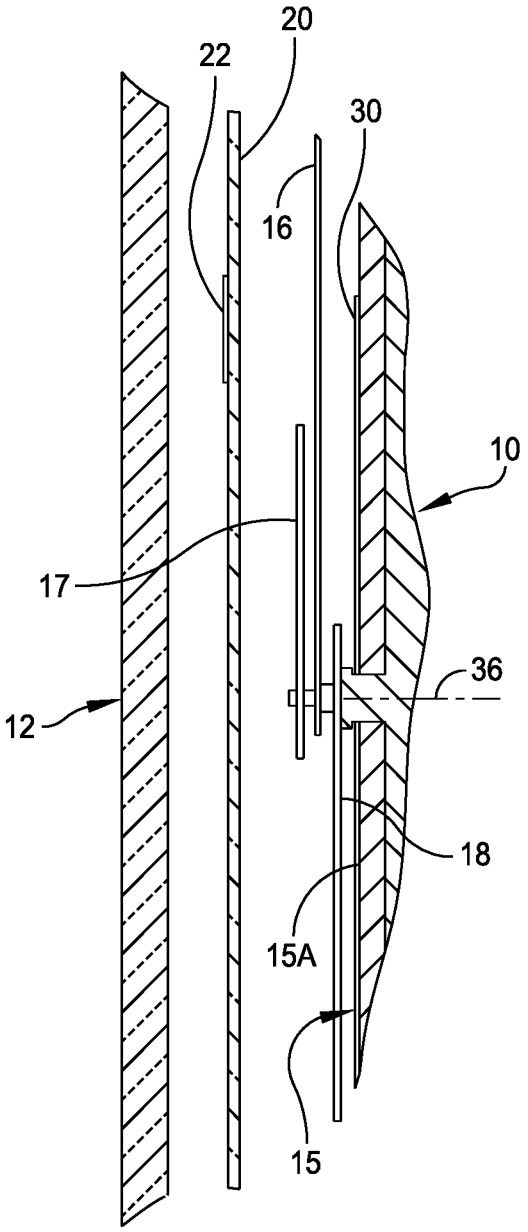
FIG. 4 is an exploded cross-sectional view related to FIG. 3.

There may be multiple embodiments that can be taken advantage of in illustrating the principle of the present invention. In a most simplified version, the net is simply formed, along with the sports player and its environment at a watch face front surface; shown in the drawings by the reference number 15A. In this regard refer to the cross-sectional views of FIGS. 3 and 4 depicting indicia at 30 representative of the sports player and the associated environment. Views such as shown in FIGS. 1 and 2 show the sports player and environment including the sports player as well as the sports player's hand indicated at 32. All of the timing hands shown in the drawings rotate about a center axis 36. See, for example, FIG. 8.

Figure 8:
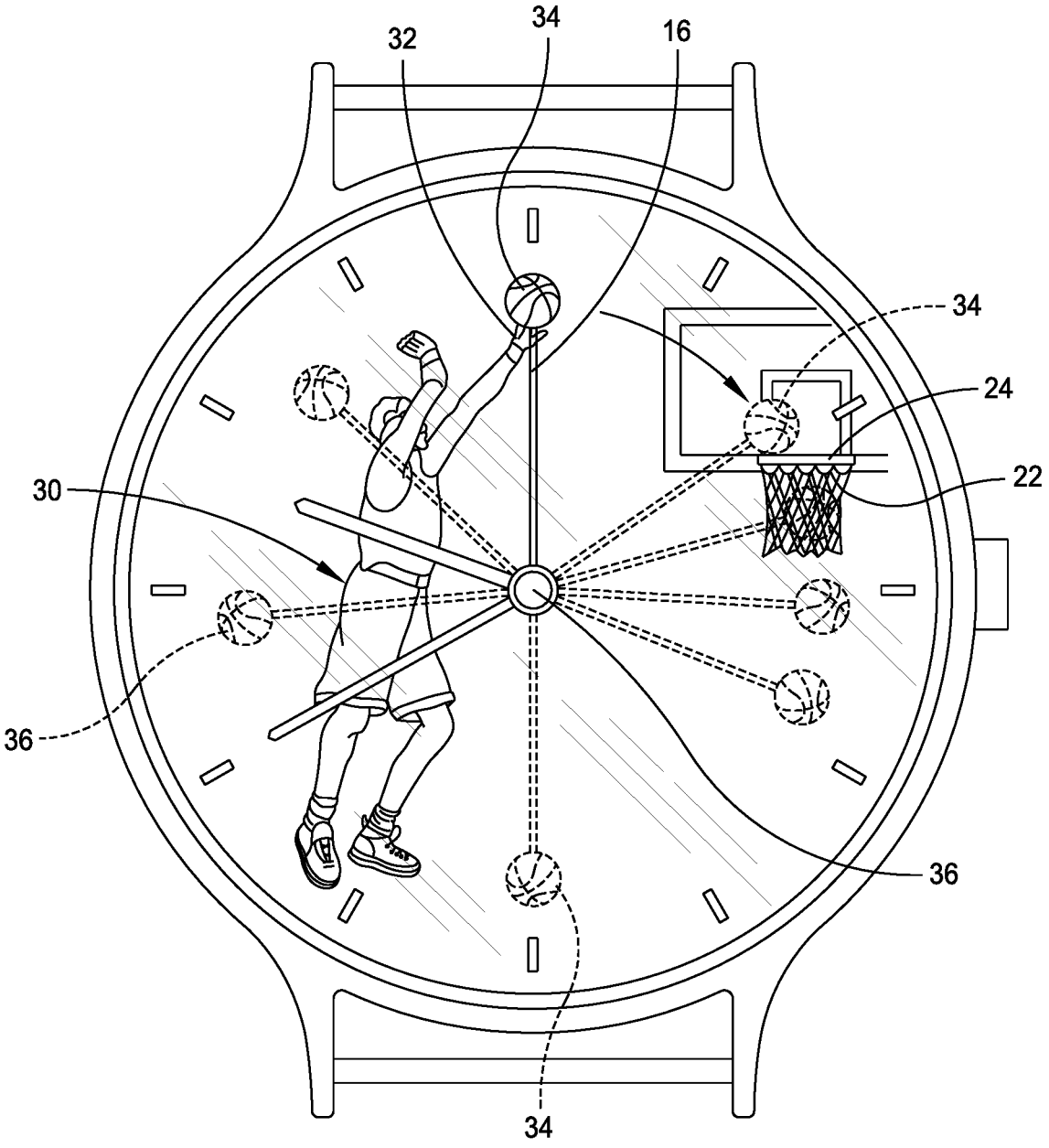
FIG. 8 is a front view illustrating the sweeping action of the seconds hand particularly as it relates to both the sports player and the net.

In the simplest embodiment of the present invention, the net 22 along with the sports player and associated environment is all depicted on the watch face front surface 15A. The various components including the net are specifically arranged; particularly in relationship to the object 34 so that, as the seconds hand 16 rotates, the object 34, which in this case is a basketball, rotates through 360 degrees. The ball 34 in FIG. 8, where it appears to come into contact with the players hand 32, is at a noon position. Refer in particular to FIG. 8 that shows this one position where the ball 34 is in a position adjacent to the player's hand 32 as the ball progresses in the direction of arrow A. The seconds hand 16 progresses through 360 degrees in a minute. At a later time in the sequence, as the seconds hand 16 rotates, the ball 34 is shown in dotted outline at a location where the ball is about to enter the rim 24 of the net 22. This is at an approximate position of 2 o'clock. The track of the seconds hand is considered as following a circular locus which is basically in the direction of arrow A.

Figure 5:
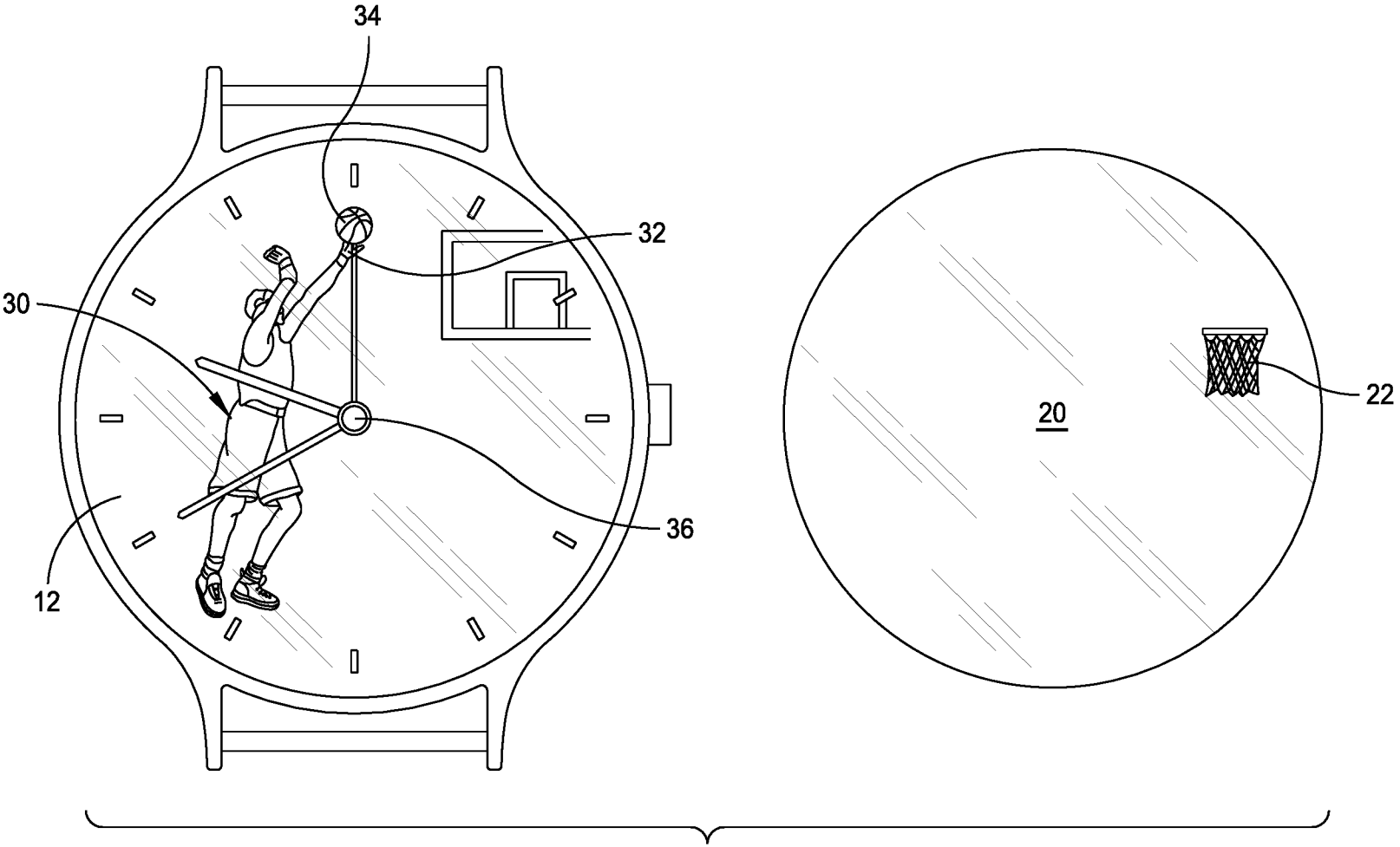
FIG. 5 is an illustration of the use of a transparent layer for depicting the net.
Figure 6:
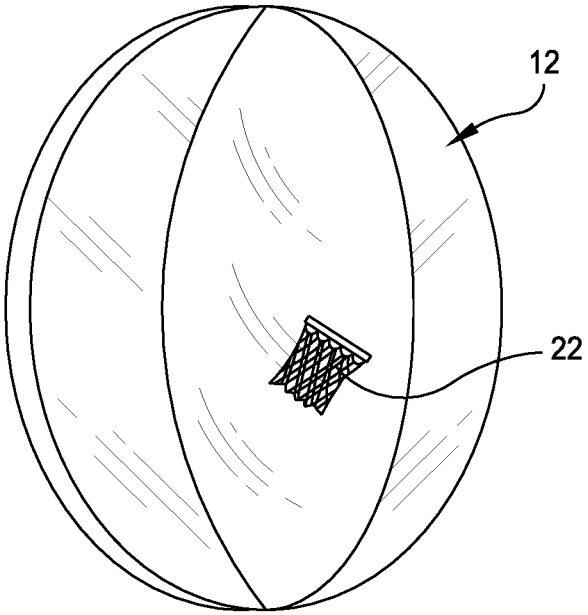
FIG. 6 is a rendition of the net being applied to the inside of the watch crystal.
Figure 7:
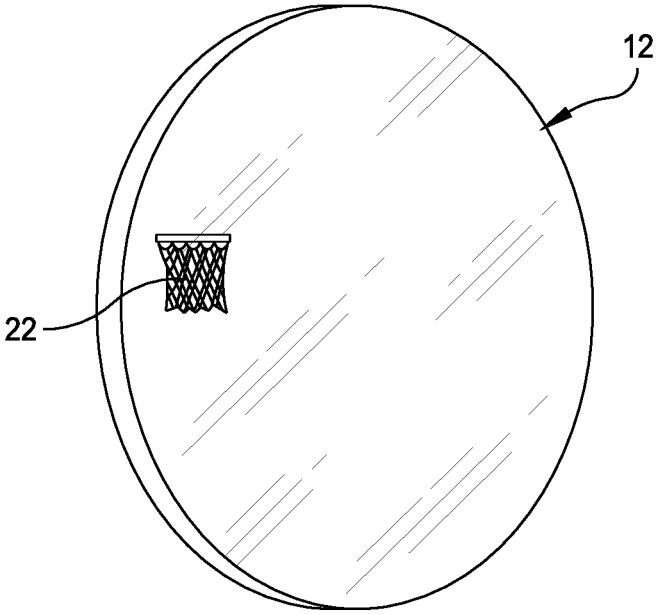
FIG. 7 shows a net decal at 22A affixed to the transparent layer.

One embodiment of the present invention is illustrated in FIGS. 1-8. The various components are best illustrated in the cross-sectional views of FIGS. 3 and 4. This includes a transparent watch crystal 12 and a watch face illustrated at 15. The watch face 15 has a front surface 15A that carries at least indicia representative of the sports player and associated environment, indicated at 30. The cross-section views of FIGS. 3 and 4 also illustrate the transparent layer 20. In this particular embodiment, the transparent layer 20, such as illustrated in FIG. 5, has affixed thereto a decal or the like of a net illustrated at 22. The net may be affixed to either side of the transparent layer 20. FIG. 6 is an illustration in which the net is placed on the inside of the crystal face itself. FIG. 7 shows the net decal 22A on the transparent layer 20. As indicated previously, FIG. 8 shows the sequence of motion of the seconds hand. The distal end of the seconds hand supports the object or ball 34 and as the hand 16 rotates, it will get to a position where the ball is adjacent to the hand 32 thus simulating a throwing of the ball toward the net. This is illustrated in FIG. 8 by the ball 34 in dotted outline about to enter at the rim 24 of the net 22. This rotation is clearly illustrated in FIGS. 1 and 2.

Figure 9:
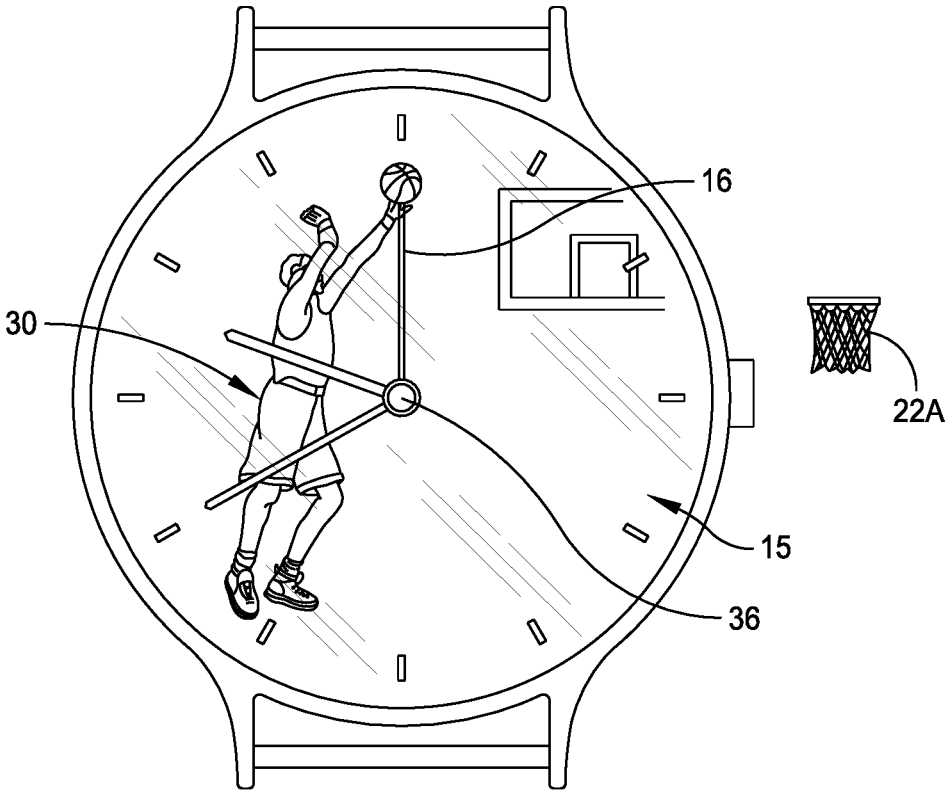
FIG. 9 illustrates another embodiment of the present invention in which the net 22 is arranged on the backside of the watch crystal.
Figure 10:
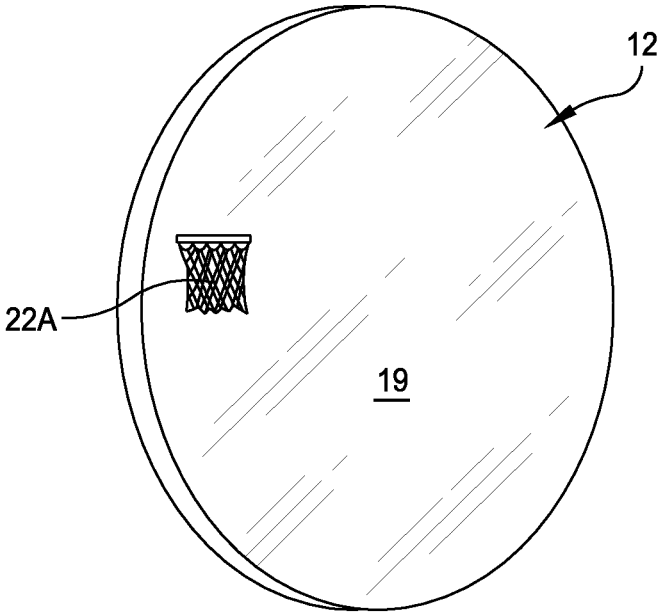
FIG. 10 illustrates the back side of the watch crystal with the net affixed.
Figure 11:
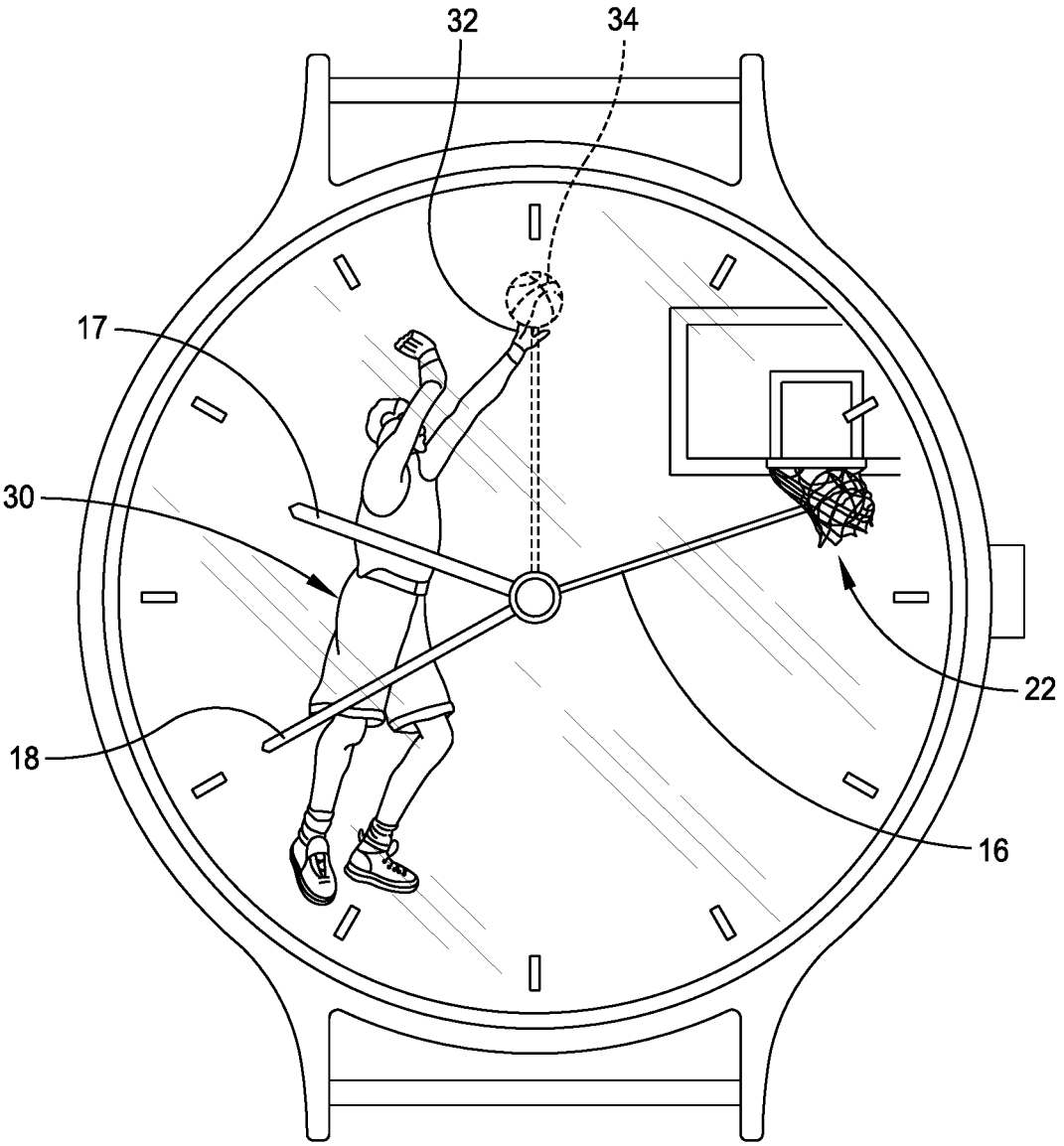
FIG. 11 is an illustration similar to that shown in FIG. 8 in which the net 22 is depicted with a "swish" action.

Reference is now made to another embodiment of the present invention illustrated in FIGS. 9-11. In this case the net 22 is in the form of a decal 22A that is affixed to the rear surface 19 of the watch crystal 12. Thus, instead of providing a separate transparent layer 20 as in FIGS. 3 and 4, there is a decal 22A that is simply applied to the rear surface 19 of the watch crystal 12.

Figure 12:
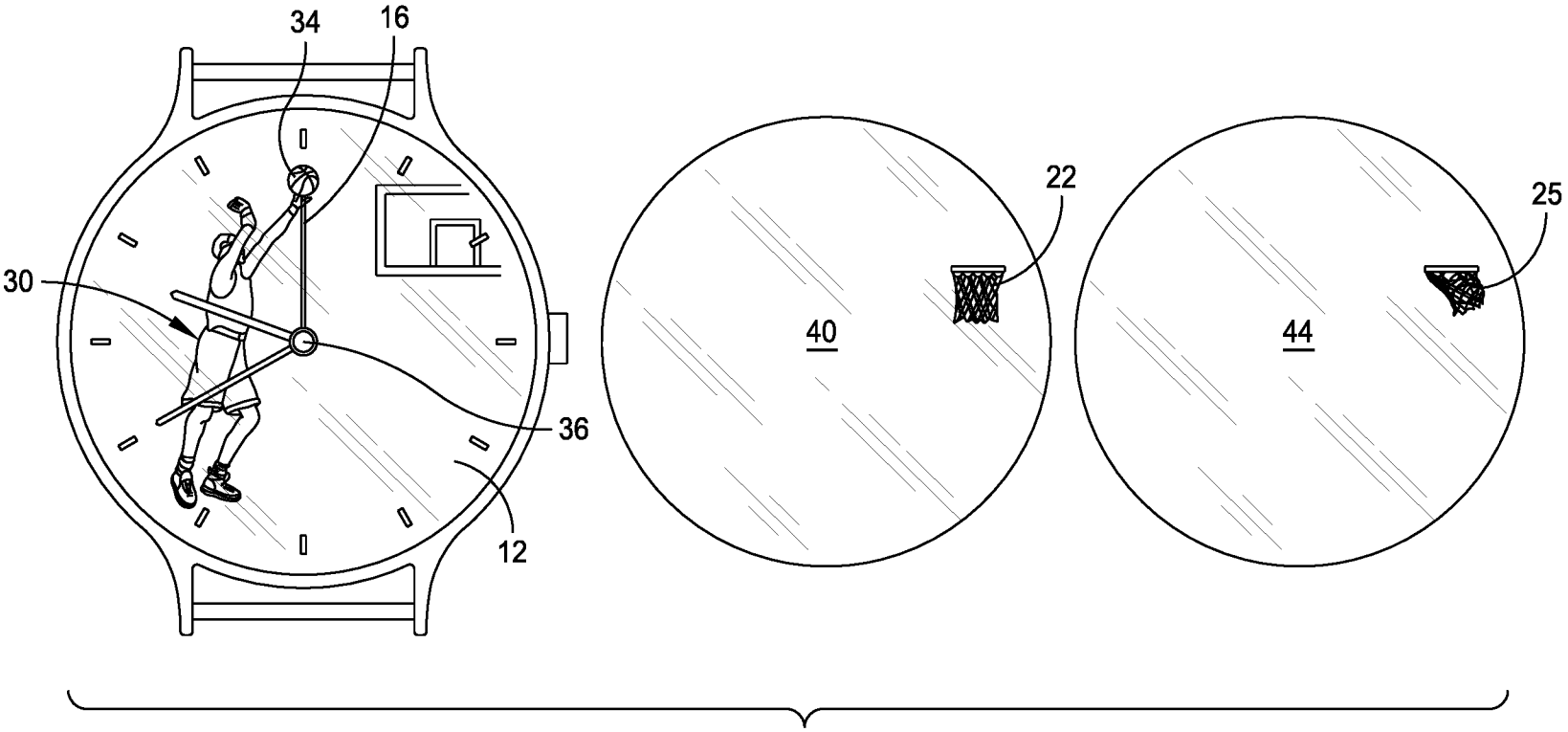
FIG. 12 depicts the use of multiple transparent layers including one that has a hologram.

Another embodiment of the present invention is illustrated in FIG. 12 in which there are multiple transparent layers; indicated in FIG. 12 by transparent layers 40 and 44. On the layer 40 is the depiction of a net at 22 while on the layer 44 there may be provided a depiction of a hologram 25. One can consider using both or either of layers 40 and 44. The use of a hologram at 25 is in particular helpful in actually providing a "swish" motion once the ball 34 passes through the net.

One of the important relationships is clear from the diagram of FIG. 8. That is where it is important that the sports player have its hand 32 in a position adjacent to or at the ball 34 as the seconds hand 16 rotates in a direction of arrow A. This replicates an action of the player actually projecting or throwing the ball 34 towards the net 22. It is also important that the ball or object 34 be placed at a position, in relationship to the net 22 so that the ball progresses through the rim 24 of the net 22. This is illustrated in FIG. 8 with the ball in dotted outline, approximately at the 2 o'clock position, shown as about to enter at the rim 24 of the net 22.

REFERENCE NUMBERS

10 watch
12 watch crystal
14 watch band
15 watch face
15A watch face front surface
16 seconds hand
17 hours hand
18 minutes hand
19 rear surface of watch crystal 12
20 transparent layer
22 net
22A net decal
24 net rim
30 indicia-sports player and environment
34 object (ball)
36 center axis
40 transparent layer
44 transparent layer

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A timepiece that is comprised of:

a face member having a face member front surface upon which is displayed indicia that is representative of time intervals, indicia of a sports player and indicia that represents the associated sports player sports environment;

time hands supported from the face member and that include an hour hand, a minute hand and a second hand with all of the hour, minute and second hands supported for rotation about a center axis of the face member;

a transparent watch crystal that is disposed in front of the face member;

a transparent layer that carries a depiction of a circular basketball hoop supporting, under the circular basketball hoop, a basketball net;

the transparent layer being disposed between the transparent watch crystal and the face member;

a circular sports object that is secured to and carried at a distal end of the second hand, and that depicts a basketball;

on the watch face, the sports player being located between a position of six o'clock and twelve o'clock, and with the majority of the sports player being disposed within a locus defined by a 360 degree rotational position of the basketball, and with the arms and hands of the sports player extending to a location adjacent to the twelve o'clock position;

on the transparent layer, the circular basketball hoop and net being located at a position between the twelve o'clock and three o'clock positions;

the depiction of the sports player including a depiction of the sports player hand that is located within the locus of the rotational position of the basketball, so that at the twelve o'clock position of the second hand the hand of the sports player is in contact with the basketball, thus simulating the shooting of the basketball toward the net;

the depiction of the rotating basketball including depicting the basketball passing, after rotating away from the twelve o'clock position, to and through the basketball hoop and the basketball net.

2. The timepiece of claim 1 wherein, on the watch face, the sports player is depicted as extending substantially vertically from a location on the order of seven o'clock at feet of the sports player to a location on the order of eleven o'clock at a head of the sports player.

3. The timepiece of claim 1 wherein, on the transparent layer the basketball hoop and net are dispose at a position on the order of two o'clock.

* * * * *